US007008902B2

(12) United States Patent
Gerecht et al.

(10) Patent No.: US 7,008,902 B2
(45) Date of Patent: Mar. 7, 2006

(54) THERMOSENSITIVE RECORDING MATERIAL AND USE THEREOF

(75) Inventors: Bernd Gerecht, Osnabrück (DE); Matthias Marx, Nortorf (DE)

(73) Assignee: Mitsubishi HiTec Paper Flensburg GmbH, Flensburg (DE)

( * ) Notice: Subject to any disclaimer, the term of this patent is extended or adjusted under 35 U.S.C. 154(b) by 0 days.

(21) Appl. No.: 10/468,634

(22) PCT Filed: Feb. 20, 2002

(86) PCT No.: PCT/EP02/01756

§ 371 (c)(1),
(2), (4) Date: Mar. 2, 2004

(87) PCT Pub. No.: WO02/068207

PCT Pub. Date: Sep. 6, 2002

(65) Prior Publication Data

US 2004/0132616 A1 Jul. 8, 2004

(30) Foreign Application Priority Data

Feb. 23, 2001 (DE) ..... 101 08 982

(51) Int. Cl.
*B41M 5/40* (2006.01)

(52) U.S. Cl. ..... 503/206; 503/200; 503/226

(58) Field of Classification Search ..... 503/200, 503/206, 226
See application file for complete search history.

(56) References Cited

U.S. PATENT DOCUMENTS

| | | | | |
|---|---|---|---|---|
| 4,577,205 | A * | 3/1986 | Shibata et al. | 503/204 |
| 5,843,864 | A | 12/1998 | Popp et al. | |
| 6,326,330 | B1 | 12/2001 | Wagner et al. | |

FOREIGN PATENT DOCUMENTS

| | | |
|---|---|---|
| DE | 197 13 590 | 10/1998 |
| DE | 197 48 258 | 5/1999 |
| DE | 198 56 857 | 6/2000 |
| DE | 199 36 030 | 2/2001 |
| EP | 0 344 705 | 6/1989 |
| EP | 0 373 903 | 6/1990 |
| EP | 0 909 242 | 4/1999 |
| JP | 111 05 422 A | 4/1999 |
| JP | 113 42 676 A | 12/1999 |

OTHER PUBLICATIONS

Product form for CAB-0-SPERSE® P 1010, Cabot Corporation, Nov. 2002.
Printout of http://www.roempp.com/prod/roempp.php, printed Mar. 24, 2003.

* cited by examiner

*Primary Examiner*—Bruce H. Hess
(74) *Attorney, Agent, or Firm*—Cohen, Pontani, Lieberman & Pavane

(57) ABSTRACT

The invention relates to a thermosensitive recording material, comprising a substrate (1), a thermosensitive recording layer (4) containing a colour former and colour acceptors, a protective layer (5) configured on the recording layer, whereby a coat (6) that covers the surface and is locally delimited is printed onto the protective layer. The invention also relates to the use of the inventive recording material as a ticket.

9 Claims, 1 Drawing Sheet

THERMOSENSITIVE RECORDING MATERIAL AND USE THEREOF

PRIORITY CLAIM

This is a national stage of PCT application No. PCT/EP02/01756, filed on Feb. 20, 2002. Priority is claimed on that application and on the following application: Country: Germany, Application No.: 101 08982.1, Filed: Feb. 23, 2001.

BACKGROUND OF THE INVENTION

1. Field of the Invention

The invention relates to a thermosensitive recording material including a substrate, a thermosensitive recording layer containing color formers and color acceptors, and a protective layer formed on the recording layer; and use thereof as a ticket.

2. Description of the Related Art

A thermosensitive recording sheet is disclosed in EP-B-0 909 242. The protective layer of the recording sheet which is to be used as a label, cash register receipt or ticket, and which can be readily printed on by the wet offset process, includes in particular, bentonite as a pigment, with a pigment content of from 20 to 40% by weight, a binder content which includes relatively large proportions of water-insoluble binder in the form of a polymer dispersions and relatively small proportions of an aqueous solution of a polymer. This publication discloses natural calcium carbonate, precipitated calcium carbonate, silica, alumina and titanium oxide as further pigments in the protective layer. While polyvinyl alcohol is mentioned as the preferred water-soluble binder, the water-insoluble binders are preferably self-crosslinking copolymers of acrylonitrile, methacrylamide and acrylic esters.

EP-A-0 344 705 discloses a protective layer in which from 0.5 to 3 parts by weight of pigment are present per part by weight of binder. Inter alia, polyvinyl alcohol, carboxymethylcellulose, starch and starch derivatives and copolymer emulsions of styrene/butadiene, vinyl acetate/ethylene, vinyl acetate/vinyl chloride/ethylene and methacrylate/butadiene are disclosed as suitable binders for the protective layer. Precipitated calcium carbonate, milled calcium carbonate, talc, kaolin, anhydrous silica, magnesium carbonate, zinc oxide, alumina and aluminum hydroxide are mentioned as suitable pigments in addition to organic pigments. Pigment-containing protective layers which contain only water-soluble binder are described by way of example.

EP-B-0 373 903 relates to a thermosensitive recording paper having an internal adhesive strength of 2.5 kg·cm or more, which has a protective layer having a smoothness of at least 500 Bekk seconds, preferably of from 700 to 1,500 Bekk seconds, which is applied to an intermediate layer containing fine particles of a styrene/acrylate polymer and a binder. Both the water-soluble and water-insoluble high polymers having adequate film formation capability are designated as binders suitable for the protective layer. An optional pigment addition to the protective layer is likewise disclosed, but the publication provides no information about the type of suitable pigments.

The known thermosensitive recording materials have proven useful in numerous applications, for example, as office papers and also as tickets, but new requirement profiles, which are often contradictory, constantly necessitate completely novel innovative products which break with the known approaches to a solution.

With the already known use of thermosensitive recording materials as a ticket, and in particular, as a travel coupon, there has been a growing need for materials which have high resistance to the environment. By this is meant that the thermosensitive recording material has an excellent resistance to water, plasticizers, oils and fats. The requirement for resistance to water arises from the fact that characters produced on a travel coupon by the supply of heat must remain decipherable and checkable for the duration of an interval of use even when the travel coupon cannot be protected by storage from exposure to the elements, such as on rainy days. In the same way, the travel coupon cannot be permitted to lose its characters on contact with fats and oils. Since travel coupons are frequently stored in document pockets in order to protect them from mechanical destruction, it is furthermore necessary for the thermosensitive recording materials used in this manner to have high resistance to plasticizers such as those usually contained in document pockets.

There is also a requirement for higher smudge resistance compared with the prior art, and hence more reliable cancelability which, in the context of the object of this invention, is to be understood as meaning that stamped-on cancellation marks cannot be wiped away after about 10 seconds, either in the dry state or in the wet state. Up to now, the only known thermosensitive recording materials are those in which the cancellation stamp ink applied to the protective layer cannot be wiped away completely from the protective layer either in the dry state or in the wet state, but the smudge resistance is still not completely satisfactory in that wiping leads to a recognizably more blurred printed image in comparison with the same printed image prior to wiping.

Since tickets and, in particular, travel coupons usually have imprints applied by means of flexographic printing processes or, in particular, by means of wet offset printing processes, printability over the entire surface of the protective layer in the areas where the cancellation imprint is not intended is a further requirement.

The necessity for recording materials suitable for use as travel coupons to be capable of being produced economically should not be underestimated. None of the thermosensitive recording materials known to date has been able to completely fulfill this spectrum of requirements.

SUMMARY OF THE INVENTION

It is an object of the present invention to provide a thermosensitive recording material which, as a ticket, and especially as a travel coupon, guarantees outstanding localized cancelability through greater smudge resistance of imprints with cancellation stamp ink. The novel recording material must be distinguished by high resistance to the environment. Furthermore, an important aspect of the novel recording material is that it must be economical to produce. Moreover, an object of the invention is to develop a recording material which, in addition to the abovementioned spectrum of requirements, also has outstanding printability over the entire surface of the protective layer in those areas in which a cancellation imprint is not intended.

As a result of extensive preliminary work, the inventors recognized that such a multiplicity of requirements, some of which are contradictory, can be met by a thermosensitive recording material that includes a substrate, a thermosensitive recording layer containing color formers and color acceptors, and a protective layer formed on the recording layer, with a solid, localized coating being imprinted on the protective layer.

For economic reasons, a particularly suitable embodiment of the present invention provides the protective layer as of a single layer.

BRIEF DESCRIPTION OF THE DRAWINGS

The invention is further explained below with reference to the accompanying figures, wherein.

DETAILED DESCRIPTION OF THE PRESENTLY PREFERRED EMBODIMENTS

Figure 1:
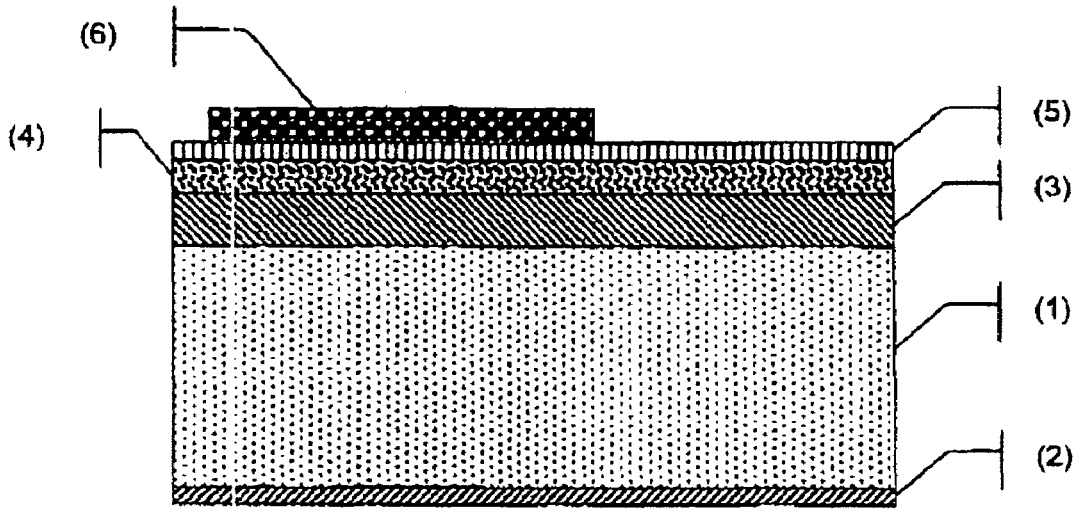
FIG. 1 shows the schematic structure of the thermosensitive recording material according to the invention in cross section.

The thermal printing head triggering the color-forming reaction of the color formers with the color acceptors in the thermosensitive recording layer causes melting of the waxy components in the recording layer. In order to avoid adhesion of these waxy components, as a melt, to the thermal printing head, it is preferable to form an intermediate layer containing a pigment or a pigment mixture between the thermosensitive recording layer and the substrate, whereby the pigments of this intermediate layer effect absorption of the melt. It is preferred that the pigments of the intermediate layer have an oil absorption of at least 80 $cm^3$/100 g, and more preferably of 100 $cm^3$/100 g, determined according to Japanese standard JIS K 5101. Because of a large absorption reservoir that exist in its cavities, calcined kaolin has proven particulary useful. In numerous experiments, it has been found that it is advantageous to choose, in the intermediate layer, pigments having higher oil absorption than in the "spot" coating, i.e. the solid and localized coating printed on the protective layer. Since the air in the cavities of the pigments of the intermediate layer is a good heat insulator, an intermediate layer formed in this manner acts as a heat reflection layer, with the result that the thermosensitivity of the recording material, and hence the printing speed in the thermal printer, can be increased. Furthermore, such an intermediate layer can make a positive contribution to the leveling of the substrate surface, with the result that the amount of coating slip, which has to be applied for the thermosensitive recording layer is reduced. The formation of an intermediate layer having a mass per unit area in the range of from 5 to 20 g/$m^2$, and preferably between 7 and 10 g/$m^2$, is particularly advantageous.

A coating slip, as proposed in EP-B-0 909 242, is suitable for the formation of the protective layer for the novel recording material of the present invention. Such a protective layer combines high resistance to the environment with outstanding printability by the wet offset process. Furthermore, the protective layer can be relatively economically produced and applied as a single layer.

In order to support the cancelability of the novel recording material of the present invention in localized areas and to ensure that only as thin a print coat of the "spot" coating as possible need be applied, which is appropriate for increased resolution of the heat-induced protective images, the following conditions have proven particularly advantageous:

- the pigment of the protective layer contains one or more inorganic pigments, and at least 80% by weight are formed from a highly purified bentonite prepared under alkaline conditions,
- the binder of the protective layer consists of one or more water-insoluble, self-crosslinking acrylic polymers,
- the binder/pigment ratio in the protective layer is in the range between 7:1 and 9:1,
- the crosslinking agent/binder ratio in the protective layer is greater than 1:5 and preferably between 1:5 and 1:7 and
- the protective layer has a smoothness of at least 900 Bekk seconds.

Natural or precipitated calcium carbonate, kaolin or titanium oxide are possible as further inorganic pigments for the protective layer.

In particular, cyclic urea, methylolurea, polyamide-epichlorohydrin resin, and ammonium zirconium carbonate are possible crosslinking agents for the protective layer.

The embodiments described above ensure a thermosensitive recording material which has good printing head behavior over the entire area and whose protective layer simultaneously has good resistance to the environment, in accordance with the object of the invention, and outstanding printability by the flexographic and wet offset process.

It is preferable to apply the protective layer in a mass per unit area in a range of from 1.5 to 6 g/$m^2$, more preferably between 1.8 and 4 g/$m^2$.

The recording material according to the invention preferably has a backing coating which is applied on the substrate side which is opposite the side provided with the thermosensitive recording layer. Such a backing coating is disclosed, for example, in DE-A-197 48 258. This backing coating serves for improved printability of the back of the recording sheet by the offset and flexographic process, and provides an improved barrier effect at the back with respect to plasticizers, oils and fats. Applied amounts in a range of from 1 to 3 g/$m^2$, and preferably between 1.5 and 2.5 g/$m^2$, have proven advantageous for the mass per unit area of the backing coating.

The solid, localized, so-called "spot", coating is preferably printed-on in, the form of a rectangle at the edge of the thermosensitive recording material finished as a travel coupon, i.e. printed and cut. The printing ink used for this purpose preferably contains pigments having an oil absorption of at least 80 $cm^3$/100 g, determined according to Japanese standard JIS K 5101. As explained above, it is advantageous to choose the oil absorption of the pigments in the intermediate layer to be greater than the oil absorption of the pigments in the "spot" coating. In an embodiment which is particularly preferred, from 60 to 90% by weight of the printing ink applied as a "spot" coating a pigment having an oil absorption of at least 80 $cm^3$/100 g. Further components of the water-based printing inks for the "spot" coating are alcohols, such as isopropanol or ethanol, as solvents and, for example, maleate, polyester and acrylate resins as binder, whose carboxyl groups have been hydrolyzed with aqueous ammonia or with amines and converted into water-soluble salts. The printing inks thus prepared are outstanding when used for stamping and the applied stamp ink is smudge-resistant after about 10 seconds.

Although not limited to paper as a substrate, paper is the substrate which has become established on the market, in view of its good environmental compatibility owing to its good recyclability. Paper is the substrate which is preferred in the present invention.

The thermosensitive recording material according to the invention is mainly conceived for use as a ticket and, in particular, as a travel coupon. After purchase and before starting the journey, the travel coupon is inserted by the passenger into a automatic cancellation apparatus provided for this purpose so that the cancellation imprint is applied to the solid, localized so-called "spot" coating. After about 10 seconds, the cancellation imprint has dried to a smudge-resistant state so that there is no danger of the passenger becoming soiled from the insufficiently fixed printing ink. At the same time, the imprint can also be readily deciphered without problems for checking purposes.

Extensive investigations have shown that a printing ink coat having a mass per unit area in a range of from 1 to 5 $g/m^2$ and in particular between 2 and 3.5 $g/m^2$ gives particularly good results.

Since the intended use of the thermosensitive recording material according to the invention as a travel coupon sometimes also requires authenticity features, the incorporation thereof is also envisaged in a preferred embodiment. An overview of possible authenticity features to be used individually or in combination is given in DE-A-199 36 030, without being restricted to the proposals made therein.

The data provided in herein on a mass per unit area basis, and in % by weight, are based in each case on the absolutely dry weight, i.e. absolutely dry parts by weight.

By the term "The high resistance to the environment of the recording material", as used according to the present invention is meant the outstanding resistance of the recording material to the following media:

water, plasticizers, and oils and fats.

The method used for establishing the resistance to the environment is based on containing envisages that a measuring cycle of 3 independent determinations of individual values per resistance test.

A determination of an individual value requires that first a DIN A4 sample is cut. For the determination of the individual value, the ratio of two measurements of the dynamic print density, determined with the aid of the Macbeth RD 914 from Karl Schröder KG (Korrillonstrasse 32, D-69469 Weinheim, Germany), is measured. For this, the sample is provided with characters using a thermal printer of the type TP 3000-300 from Charles Richiger AG, Maschinenbau (Bemstrasse 81, CH-3613 Steffisburg, Germany). After a first measurement of the dynamic print density, the sample is directly exposed to the corresponding medium for a certain time (for contact time, cf. table). The excess medium is then suctioned off or dabbed off. Medium already absorbed by the sample is allowed to act for a certain time (for standing time before measurement, see table). Finally, the dynamic print density is measured a second time.

The arithmetic mean of the 3 individual values thus determined is calculated. The investigated resistance to the medium is designated as being very good if the arithmetic mean of the quotients determined from two measured values in each case is greater, as individual values, than the "limit of character stability" according to table 1.

TABLE 1

| Medium | Water | Hand cream Pfeilring Lanolin Creme-Soft (Viva GmbH, D-50858 Cologne) | Milk (3.5% fat content) | Tesa-Grafik film 57410 (Beiersdorf, D-21147 Hamburg) |
|---|---|---|---|---|
| | | Fats and oils | | Plasticizers |
| Application | 1 drop | Dense coat | 1 drop | Different sequence |
| Contact time | 30 minutes, then suck off | 10 minutes, then dab off | 30 minutes, then suck off | here: produce characters as described; then stick on Tesa film and then measure dynamic print density |
| Standing time before measurement | 3 hours under room conditions | 3 hours under room conditions | 3 hours under room conditions | 3 hours under room conditions |
| Limit of character stability | >90% | >95% | >90% | >85% |

The following examples further illustrate the invention:

EXAMPLE 1

A paper web is produced on a Foudrinier paper machine as a substrate from bleached and beaten hardwood and softwood pulps having a mass per unit area of 67 $g/m^2$ with addition of conventional additives in conventional amounts. An 8 $g/m^2$ intermediate layer containing calcined kaolin as pigment, styrene/butadiene latex as binder and starch as cobinder, in addition to further assistants, is applied to the front.

A thermosensitive recording layer containing color formers and color acceptors, and having a mass per unit area of 5.4 $g/m^2$, is applied to the intermediate layer.

A protective layer of 2 $g/m^2$ is applied to the dried recording layer. A highly purified bentonite, which has been prepared under alkaline conditions and has a lamellar structure, and whose intrinsic adhesion permits fixing with a low binder requirement and whose specific surface area in the undispersed state is specified as 85 $m^2/g$, is used as a pigment with an area/edge ratio which, in the case of the bentonite present in powder form, varies within a range between 20 and 50. A binder/pigment ratio of 6:1 and a crosslinking agent/binder ratio of 1:5 are established. The crosslinking agent used is a polyamide-epichlorohydrin resin and the binder used is the aqueous dispersion of a self-crosslinking copolymer of acrylonitrile, methacrylamide and acrylic esters. The coating slip for the production of the protective layer contains, as further components, an antifoam, stearic acid as a lubricant, and various dispersants for the pigment and for the lubricant.

The applied coating slip is dried and the recording sheet produced to this stage is smoothed by means of a calander, with a smoothness of 2,200 Bekk seconds being achieved.

In each case 8 mm wide strips are then printed as "spot" coatings in a mass per unit area of 2.2 g/m$^2$ on the protective layer in such a way that the "spot" coating strips in the finally cut travel coupon are arranged at two opposite outer lines of the travel coupon. The printing ink "DG 9033 (matt coat)" supplied by GSB-Wahl GmbH, Buchenteich 1, D-73773 Aichwald, is used.

That side of the thermo sensitive recording material according to the invention produced in this manner, which is provided with a protective layer, is checked with regard to its resistance to the environment in the areas not printed with a "spot" coating, and is determined to be very good. The cancellation imprint is checked after 10 seconds with a moistened finger with regard to its smudge resistance; the cancellation imprint cannot be smudged.

EXAMPLE 2

In each case 10 mm×50 mm "spot" coating rectangles are printed in a mass per unit area of 3.2 g/m$^2$ on the protective layer of a thermosensitive recording material produced according to example 1 of EP-B-0 909 242, in such a way that the "spot" coating rectangles in the finally cut travel coupon are arranged with their long side parallel to an outer line of the travel coupon. The printing ink "DG 9033 (matt coat)" supplied by GSB-Wahl GmbH, Buchenteich 1, D-73773 Aichwald, is used.

That side of the thermosensitive recording material according to the invention produced in this manner, which is provided with a protective layer, is checked with regard to its resistance to the environment in the areas not printed with a "spot" coating, and is determined to be very good. The cancellation imprint is checked after 10 seconds with a moistened finger with regard to its smudge resistance; the cancellation imprint cannot be smudged.

EXAMPLE 3

In each case 10 mm×50 mm "spot" coating rectangles are printed in a mass per unit area of 2.8 g/m$^2$ on the protective layer of a thermosensitive recording material produced according to example 2 of EP-B-0 909 242, in such a way that the "spot" coating rectangles in the finally cut travel coupon are arranged with their long side parallel to an outer line of the travel coupon. The printing ink "DG 9032" supplied by GSB-Wahl GmbH, Buchenteich 1, D-73773 Aichwald, is used.

That side of the thermosensitive recording material according to the invention, produced in this manner, which is provided with a protective layer, is checked with regard to its resistance to the environment in the areas not printed with a "spot" coating, and is determined to be very good. The cancellation imprint is checked after 10 seconds with a moistened finger with regard to its smudge resistance; the cancellation imprint cannot be smudged.

EXAMPLE 4

In each case 10 mm×50 mm "spot" coating rectangles are printed in a mass per unit area of 3.3 g/m$^2$ on the protective layer of a thermosensitive recording material produced according to example 3 of EP-B-0 909 242, in such a way that the "spot" coating rectangles in the finally cut travel coupon are arranged with their long side parallel to an outer line of the travel coupon. The printing ink HK 9035 supplied by Akzo Nobel, Kreuzauer Strasse 46, D-52301 Düren is used. That side of the thermosensitive recording material according to the invention produced in this manner which is provided with a protective layer is checked with regard to its resistance to the environment in the areas not printed with a "spot" coating and is determined to be very good. The cancellation imprint is checked after 10 seconds with a moistened finger with regard to its smudge resistance; the cancellation imprint cannot be smudged.

Referring now to FIG. 1, a backing coating (2) is applied to the underside of the substrate (1). In the sequence represented, an intermediate layer (3), a thermosensitive recording layer (4), and a protective layer (5), are applied to the front of the substrate (1). Finally, a solid, localized print coat (6) is arranged on the protective layer.

Figure 2:
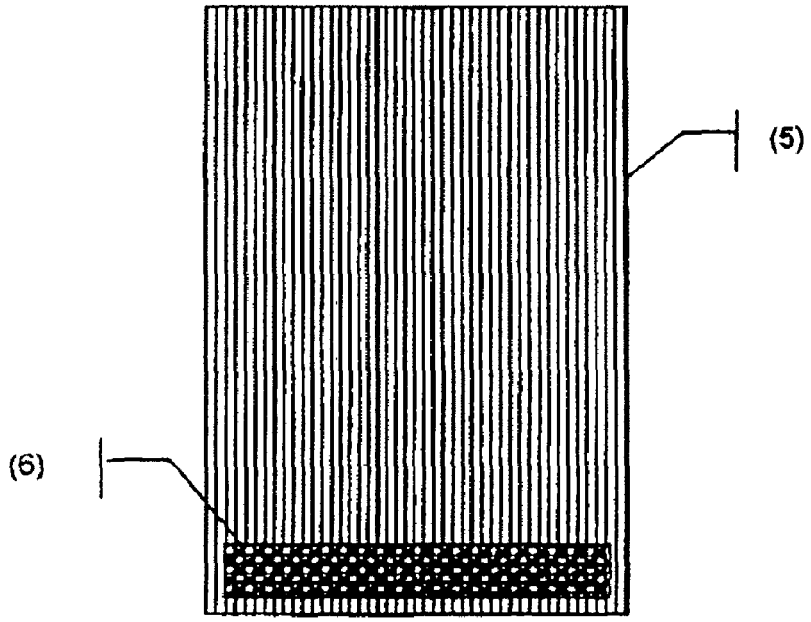
FIG. 2 shows a plan view of the thermosensitive recording material according to the invention, cut to form a travel coupon.

Referring to FIG. 2 the solid, localized print coat (6), in the form of a rectangle which is arranged with its long side parallel to an outer line of the travel coupon, is applied to the protective layer (5) exclusively visible in the plan view.

What is claimed is:

1. A thermosensitive recording material, comprising:

a substrate, a thermosensitive recording layer containing color formers and color acceptors, an intermediate layer containing a pigment or pigment mixture formed between the substrate and the thermosensitive recording layer, a protective layer formed on the recording layer, an area for receiving a stamped image being defined on a side of the protective layer facing away from the thermosensitive recording layer, and a localized coating including printing ink having pigments applied to the protective layer, the localized coating covering the area for receiving a stamp, wherein 60–90% by weight of the printing ink in the localized coating comprises pigments having an oil absorption of at least 80 cm$^3$/100 g, and wherein the pigment or pigment mixture in the intermediate layer has a higher oil absorption than that of the pigments in the printing ink of the localized coating.

2. The thermosensitive recording material as claimed in claim 1, wherein the applied printing ink in the localized coating comprises a polyester- or acrylic resin-containing binder.

3. The thermosensitive recording material as claimed in claim 1, wherein the protective layer is formed as a single layer.

4. The thermosensitive recording material as claimed in claim 1, wherein the protective layer has a smoothness of at least 900 Bekk seconds.

5. The thermosensitive recording material as claimed in claim 1, wherein the applied printing ink in the localized coating contains pigments having an oil absorption of at least 80 cm$^3$/100 g.

6. The thermosensitive recording material as claimed in claim 1, further comprising a backing coating applied to a side of the substrate which is opposite the side with the thermosensitive recording layer.

7. The thermosensitive recording material as claimed in claim 1, wherein the substrate is paper.

8. The thermosensitive recording material as claimed in claim 1, wherein the thermosensitive recording material comprises a ticket.

9. The ticket thermosensitive recording material as claimed in claim 8, wherein the localized coating in the area for receiving a stamp is arranged and dimensioned for receiving and retaining the application of at least one stamped image comprising a cancellation imprint.

* * * * *